US006239084B1

(12) United States Patent
Eliades et al.

(10) Patent No.: US 6,239,084 B1
(45) Date of Patent: May 29, 2001

(54) VISCOSITY DRIFT CONTROL IN OVERBASED DETERGENTS

(75) Inventors: Theo I. Eliades, Scarborough; Ronald J. Muir, West Hill, both of (CA); Leonard A. Matthews, Gretna, LA (US)

(73) Assignee: Crompton Corporation, Greenwich, CT (US)

( * ) Notice: Subject to any disclaimer, the term of this patent is extended or adjusted under 35 U.S.C. 154(b) by 0 days.

(21) Appl. No.: 09/358,633

(22) Filed: Jul. 21, 1999

Related U.S. Application Data

(63) Continuation-in-part of application No. 09/031,284, filed on Feb. 26, 1998, now abandoned.

(51) Int. Cl.[7] ..... C10M 101/104; C10M 135/10
(52) U.S. Cl. ..... 508/398; 508/400
(58) Field of Search ..... 508/391, 398, 508/400

(56) References Cited

U.S. PATENT DOCUMENTS

| | | | | |
|---|---|---|---|---|
| Re. 35,461 | * | 2/1997 | Marsh et al. | 508/322 |
| 3,480,550 | * | 11/1969 | Henderson et al. | 508/591 |
| 3,878,115 | * | 4/1975 | Souillard et al. | 508/391 |
| 4,104,180 | * | 8/1978 | Burnop | 508/391 |
| 4,283,294 | * | 8/1981 | Clarke | 508/391 |
| 4,387,033 | * | 6/1983 | Lenack et al. | 508/391 |
| 4,863,624 | * | 9/1989 | Emert et al. | 508/337 |
| 4,873,008 | * | 10/1989 | Landis | 508/391 |
| 5,011,618 | * | 4/1991 | Parke et al. | 508/391 |
| 5,069,804 | * | 12/1991 | Marsh et al. | 508/322 |
| 5,126,062 | * | 6/1992 | Barnes | 508/395 |
| 5,505,867 | | 4/1996 | Ritter et al. . | |
| 5,589,445 | * | 12/1996 | Leahy et al. | 508/381 |

FOREIGN PATENT DOCUMENTS

| | | |
|---|---|---|
| 0094814 | 5/1983 | (EP) . |
| 0296674 | 6/1988 | (EP) . |
| 818325 | 8/1959 | (GB) . |
| 9904153 | 2/1999 | (WO) . |
| 9943771 | 9/1999 | (WO) . |

* cited by examiner

*Primary Examiner*—Margaret Medley
(74) *Attorney, Agent, or Firm*—Shirley S. Ma

(57) ABSTRACT

Viscosity increase or drift control occurs in overbased detergents in storage over time and particularly at elevated temperatures. Viscosity drift is now controlled by the addition of additive amounts of a compound having an oleophilic group and further having secondary hydroxyl functionality to a detergent in storage prior to incorporation in a finished oil. Additions of this control agent in additive amounts of about 0.1 to 5.0%, and preferably 0.25 to 1.0%, by weight effected minimal viscosity drift of no more than about 10% where the detergent was stored at elevated temperatures of about 37° C. to 82° C. for about 4 weeks. The degree of viscosity drift control is proportional to the amount of control agent added to the overbased detergent. Preferred viscosity drift control agents are alkylated phenols such as dinonyl phenol, vegetable oils such as canola oil and jojoba oil, and hydroxy carboxylic acids such as 12-hydroxy stearic acid. The viscosity drift control agent is particularly effective for the storage of highly overbased calcium sulfonates.

28 Claims, No Drawings

VISCOSITY DRIFT CONTROL IN OVERBASED DETERGENTS

PRIOR RELATED APPLICATIONS

This application is a continuation-in-part of Ser. No. 09/031,284, filed Feb. 26, 1998 now abandoned.

BACKGROUND OF THE INVENTION

1. Field of the Invention

This invention relates to viscosity drift control in overbased detergents, principally overbased sulfonates and phenates. The invention move specifically relates to the method and composition for controlling viscosity drift in a detergent in storage prior to incorporation in a finished lubricating oil.

2. Background and Discussion of the Prior Art

Overbased detergents are extensively used in lubricating oils. Generally, the overbased detergent is shipped and stored prior to incorporation in the lubricating oil. The storage and shipping conditions often expose the detergent to temperatures substantially above ambient for long periods of time. It was found that overbased detergents would, over time, and under elevated temperatures, increase in viscosity. This viscosity increase or drift caused the overbased detergent to be out of specification with the initially specified viscosity, and in certain cases the viscosity of the stored overbased detergent had sufficiently increased so as not to be useful for blending in the lubricating oil. The lubricating oil art was directed away from overbased detergents having high viscosities because of handling and filter ability problems, as discussed in U.S. Pat. No. 5,011,618 to Papke et al and U.S. Pat. No. 4,387,033 to Lenack et al.

Overbased calcium sulfonate detergents were generally required to have a viscosity of no more than about 200 to 250 cSt at 100° C., but after several weeks of storage particularly under elevated temperatures, the detergent viscosity would drift to 400 cSt at 100° C. or more. The increased or high viscosity overbased calcium sulfonate was then unsuitable for blending and use in lubricating oils.

While it was known in the lubricating oil art to add certain alkyl phenols and vegetable oils to finished blended lubricating oils to enhance certain performance characteristics, it was not known that limited amounts of such additives when added to an overbased detergent per se in contradistinction to a lubricating oil effectively controlled viscosity drift in long term storage of the detergent prior to blending the detergent in a lubricating oil.

The art directed to processes for producing overbased detergents recognized that certain alkyl phenols could be used as co-promoters, as disclosed in Burnop, U.S. Pat. No. 4,104,180. Where alkyl phenols were used as co-promoters, the overbased detergent co-promoter reaction product had no effect as a viscosity drift control agent, The alkyl phenol co-promoter detergent would undergo substantial viscosity drift in storage.

The overbased detergent art desired a viscosity drift control agent or system which reduced or eliminated viscosity drift of the detergent in storage.

The term "viscosity drift" as used hereinbefore and hereinafter means the change (increase) in viscosity over time. The term "viscosity drift control" as used hereinbefore and hereinafter means the reduction in the change (increase) in viscosity over time. The term "additive amount(s)" as used hereinbefore and hereinafter means about 0.1 to 5.0% by weight.

SUMMARY OF THE INVENTION

A viscosity drift control system for overbased detergents is achieved by adding additive amounts of a compound having an oleophilic group and having secondary hydroxyl functionality to an overbased detergent in storage and prior to incorporation in a finished lubricating oil. This viscosity drift control additive or agent of the present invention when added in additive amounts to the overbased detergent results in a viscosity which over several weeks at elevated temperatures remains relatively unchanged or slightly elevated, whereas absent the agent, the viscosity would over time increase to wherein the detergent is commercially unacceptable. The agent of the present invention permits the overbased detergent to remain in specification so as to be useful in a finished oil.

The viscosity drift control agent of the present invention is effective in additive amounts of 0.1 to 5% by weight and preferably 0.25 to 1.0% by weight in the overbased detergent. These additive amounts of the viscosity drift control agent reduce viscosity drift to less than a 10% increase in the initial viscosity over a period of 4 weeks at elevated temperatures above about 35° C.

The viscosity drift control agent generally includes at least one of: (1) vegetable oils, (2) carboxylic acids and (3) alkyl phenols.

DESCRIPTION OF THE PREFERRED EMBODIMENTS

In one aspect the present viscosity drift control system is a method for controlling viscosity drift in a detergent which includes providing an overbased detergent subject to viscosity drift and adding an additive amount of a viscosity drift control agent having an oleophilic group and secondary hydroxyl functionality, and storing the detergent prior to incorporation in a finished lubricating oil, whereby the detergent viscosity drift is reduced.

In another aspect, the viscosity drift control agent of the present invention includes generally three classes of compounds having an oleophilic group and secondary hydroxyl functionality, as further discussed hereinafter. It is to be understood that such secondary hydroxyl functionality pursuant to the present invention contemplates OH, OH—HO hydrogen bonding as in inter-fatty acid triglyceride hydrogen bonding (e.g., vegetable oils), and OH in the ester form of this functional group. The viscosity drift control agents are preferably of moderately high molecular weight (MW). The viscosity drift control agents have a molecular weight of about 150 to 1,000 or more, and preferably between about 260 and 1,000.

It has been found that three classes of compounds fall within the aforesaid definition of viscosity drift control agents pursuant to the present invention. These classes of viscosity drift control agents are (1) vegetable oils, (2) carboxylic acids and (3) alkyl phenols, having an oleophilic group and further having secondary hydroxyl functionality. Suitable vegetable oils include canola oil, jojoba oil, sunflower oil, rapeseed oil, linseed oil, palm kernel oil, castor oil and hydrogenated castor oil, and the like. Vegetable oils such as canola oil and jojoba oil are preferred. The alkyl phenols include mono, di, linear and branched alkyl phenols. The alkyl group of the alkyl phenol may have up to 40 carbon atoms, and preferably 6 to 20 carbon atom. Useful alkyl phenols including mono, di and tri substituted alkyl phenols. Examples of useful alkyl phenols are heptyl phenols, octylphenols, dodecylphenols, nonylphenols and cyclohexyl phenols. It is to be understood that the terms "alkyl phenol" or "alkyl phenols" are used herein to represent one or more such alkyl phenols. Dinonyl phenol is a preferred alkyl phenol. Suitable carboxylic acids pursuant to the present invention include mono hydroxy alkane carboxylic acids having from 8 to 18 carbon atoms or higher wherein the hydroxyl group is, by way of example, in the beta, gamma or delta or further substituted position with respect to the carboxyl group, such as hydroxy caprylic acids, hydroxy lauric acids, hydroxy myristic acids, hydroxy palmitic acids, hydroxy stearic acids, and hydroxy arachidic acids as well as their homologs and analogs. A 12-hydroxy stearic acid is a preferred carboxylic acid. It is to be noted that the aforesaid useful compounds contain both an oleophilic group and secondary hydroxyl functionality.

The viscosity drift control agent is effective in amounts of 0.1 to 5% by weight and preferably 0.25 to 1.0%. The viscosity drift control effect is generally proportional to the amount of agent added to the detergent. The viscosity drift effected by additive amounts of the control agents of the present invention is less than about 10% over 4 weeks. That is, the initial viscosity of the combination of the overbased detergent and control agent increases or drifts less than about 10% over 4 weeks. The controlled viscosity drift is generally about 5 to 25 cSt at 100° C., where 0.1 to 5 % by weight of the control agent is added to the overbased detergent and the detergent stored at about 46° C. to 49° C. for about 4 weeks.

It has generally been found that detergents stored for about 4 weeks, particularly at elevated temperatures of above about 35° C., had viscosity drifts of at least about 30% or more. Where control agents of the present invention were added to the detergent in additive amounts of 0.1 to 5% by weight, the viscosity drift is generally reduced to about 10% to 15% over 4 weeks at such elevated temperatures. In many cases, the viscosity drift control agents of the present invention reduced the viscosity drift to less than about 10% over 4 weeks at storage temperatures above about 35° C.

It has been found that one of the most preferred and most effective viscosity drift control agents is an alkyl phenol, and particularly dinonyl phenol (DNP). It was found, and as further demonstrated herein, that about 0.5% by weight of DNP in a detergent reduced the viscosity drift to less than about 10% where the detergent was stored at elevated temperatures of about 37° C. to 82° C. for about 4 weeks. The lubricating oil art is particularly conservative in that it is reluctant to introduce radically new compounds into commercial lubricating oils. The alkyl phenols are therefore particularly preferred because they bear some structural similarity to phenates, which in one form are commercially useful overbased detergents. The use of an alkyl phenol, such as dinonyl phenol, is perceived by the lubricating oil art as not introducing a structurally suspect compound which might otherwise result in adverse performance characteristics. Further, insofar as only 0.5% by weight of DNP was found to be extremely effective, DNP is most preferred for its minimal use requirement and concomitant low cost, as well as for its commercially perceived structural acceptability.

The foregoing viscosity drift control agents are produced by procedures well known in the art and are commercially available. Canola oil is a particularly effective agent, and is readily commercially available and inexpensive, and for these reasons is another preferred viscosity drift control agent.

The overbased detergents are produced by procedures well known in the art and are commercially available. Suitable detergents useful in the present inventions include the Group I and Group II metal sulfonates, phenates and carboxylates. Particularly useful for viscosity drift control are the overbased calcium sulfonates and phenates. Highly overbased sulfonates and phenates are particularly subject to increased viscosity, and the drift control agents of the present invention are particularly effective for these highly overbased products. Highly overbased sulfonates and phenates are those having, a TBN in excess of about 200 and preferably more than 400.

The following examples are illustrative of the invention. The viscosities are reported in the examples as cSt at 100° C. unless otherwise indicated.

EXAMPLES 1–3

A sample of an overbased calcium sulfonate, TBN 400, was produced by sulfonating a 65 and 150 cSt at 40° C. petroeleumf oil and blending with 0 to 30% sulfonic acid made by sulfonating a synthetic, mainly dialkyl benzene alkylate having, a molecular weight of 430 to 560. The sulfonic acid composition is overbased by carbonating in the presence of calcium hydroxide, solvent, alcohol and oil, according to procedures well known in the art. The product calcium sulfonate had an initial viscosity of 33 1 cSt at 100° C. and was treated with dinonyl phenol (Example 1), canola oil (Example 2) and jojoba oil (Example 3) and held at about 46° C. to about 49° C. for several weeks during which time the viscosities were measured.

EXAMPLE 1

| Dinonyl phenol Amt. added | Viscosity | | | | |
|---|---|---|---|---|---|
| (wt. %) | Initial | 1 wk | 2 wks | 3 wks | 4wks |
| 0 | 331 | 377 | 402 | 424 | 446 |
| 0.25 | 275 | 280 | 289 | 294 | 300 |
| 0.50 | 257 | 262 | 268 | 276 | 280 |
| 1.00 | 238 | 245 | 250 | 256 | 259 |
| 2 | 226 | 231 | 236 | 241 | 246 |
| 3 | 210 | 210 | 212 | 214 | 216 |

EXAMPLE 2

| Canola Oil Amt. added | Viscosity | | | | |
|---|---|---|---|---|---|
| (wt. %) | Initial | 1 wk | 2 wks | 3 wks | 4wks |
| 0.50 | 255 | 262 | 273 | 285 | 311 |
| 1.00 | 237 | 242 | 249 | 255 | 261 |
| 2 | 212 | 213 | 217 | 222 | 227 |
| 5 | 166 | 166 | 167 | 178 | 170 |

EXAMPLE 3

| Jojoba Oil Amt. added | Viscosity | | | | |
|---|---|---|---|---|---|
| (wt. %) | Initial | 1 wk | 2 wks | 3 wks | 4wks |
| 5.00 | 142 | 147 | 150 | 154 | 155 |

The results of Examples 1–3 demonstrate that dinonyl phenol and the vegetable oils, namely the canola and jojoba oils, provide significant viscosity drift control under elevated temperatures of 46° C. to 49° C. over an extended period of 4 weeks. The viscosity drift using 0.2 to 5 % of the viscosity control agent (i.e. dinonyl phenol, canola oil and jojoba oil), after four weeks under elevated temperatures of about 46° C. to about 49° C., is no more than about 5 to 25 cSt at 100° C. Examples 1 and 2 also demonstrate that the viscosity drift control is proportional to the amount of agent added.

EXAMPLE 4

Diverse Viscosity Drift Control Agents

An overbased calcium sulfonate having a 405 TBN was stored at 71° C. to 82° C. with diverse viscosity drift control agents added, and the viscosity was increased over several weeks.

| Additive Amount | Viscosity | | | | |
|---|---|---|---|---|---|
| (wt. %) | Initial | 1 wk | 2 wks | 3 wks | 4 wks |
| none | 268 | 289 | 320 | 360 | 405 |
| 0.5% dinonylphenol | 254 | 255 | 266 | 272 | 279 |
| 1.0% dinonylphenol | 235 | 245 | 246 | 253 | 257 |
| 2.0% dinonylphenol | 233 | 231 | 236 | 243 | 246 |
| 2.0% canola oil | 170 | 180 | 180 | 187 | 193 |
| 2.0% 12-hydroxy stearic acid | 266 | 261 | 274 | 288 | 295 |
| 2.0% jojoba oil | 170 | 180 | 180 | 187 | 192 |
| 5.0% jojoba oil | 167 | 171 | 174 | 177 | 178 |

The results of Example 4 demonstrate that diverse viscosity drift control agents within the scope of the invention effectively reduce viscosity drift to no more than about 10% for detergents stored for 4 weeks at elevated temperatures of 71° C. to 82° C.

EXAMPLE 5

Controls

An overbased calcium sulfonate having a 405 TBN was stored at 71° C. to 82° C. blended with additive amounts of diverse compounds not within the scope of definition of the invention, and the viscosity measured over several weeks.

| Additive Amount | Viscosity | | | | |
|---|---|---|---|---|---|
| (wt. %) | Initial | 1 wk | 2 wks | 3 wks | 4 wks |
| none | 268 | 289 | 320 | 360 | 405 |
| 2% water | 230 | 265 | 310 | 355 | 402 |
| 1% Rhodamine T (long chain amine) | 226 | 242 | 280 | 320 | 362 |
| 2% Co-530 (ethoxylated phenol) | 220 | 265 | 297 | 330 | 385 |
| 2% Isofol 24 ($C_{24}$ alcohol) | 266 | 318 | 343 | 372 | — |

Example 5 demonstrates that diverse compounds outside the scope of the definition of the present invention are not useful as viscosity drift control agents. The ethoxylated phenol and the $C_{24}$ alcohol are compounds which have oleophilic groups and hydroxyl functionality, however the hydroxyl functionality is primary and not secondary. These compounds are therefore outside the scope of the definition of viscosity drift control agent pursuant to the present invention, and do not control viscosity drift. This demonstrates the criticality of the combination of an oleophilic group and secondary hydroxyl functionality, pursuant to the present invention.

EXAMPLE 6

Dinonyl Phenol (DNP)

The following Tables 6A and 6B (viscosity vs. temperature) report the viscosities of an overbased calcium sulfonate having a 400 TBN, with and without dinonyl phenol (DNP), respectively, where in both cases the detergent was stored for 4 weeks at the same specified temperatures.

TABLE 6A

| 400 TBN Overbased Calcium Sulfonate Without DNP Viscosity | | | | |
|---|---|---|---|---|
| Temperature | 37.8° C. | 48.9° C. | 65.6° C. | 82.2° C. |
| initial | 193 | 193 | 193 | 193 |
| 1 wk | 194 | 203 | 207 | 209 |
| 2 wks | 196 | 201 | 216 | 216 |
| 3 wks | 203 | 220 | 232 | 236 |
| 4 wks | 207 | 228 | 251 | 265 |

TABLE 6B

| Same 400 TBN Overbased Calcium Sulfonate With 0.5% DNP Viscosity | | | | |
|---|---|---|---|---|
| Temperature | 37.8° C. | 48.9° C. | 65.6° C. | 82.2° C. |
| initial | 181 | 181 | 181 | 181 |
| 1 wk | 183 | 186 | 184 | 188 |
| 2 wks | 178 | 182 | 186 | 189 |
| 3 wks | 181 | 186 | 191 | 195 |
| 4 wks | 187 | 189 | 193 | 201 |

The results of Tables 6A and 6B demonstrate that with the use of a 0.5% DNP viscosity drift control agent, the viscosities of a 400 TBN calcium sulfonate detergent were relatively stable over four weeks, even at elevated temperatures. More specifically, where the overbased calcium sulfonate detergent was stored at temperatures of from about 37° C. to 82° C. for 4 weeks, with 0.5% DNP and without DNP, it was specifically demonstrated that the DNP controlled viscosity drift to less than about 10%.

EXAMPLE 7

Lubricating Oil Non-Viscosity Drift

Three (3) detergent/lubricating oil blends in different weight ratios and one neat detergent control were made with a TBN 400 calcium sulfonate and a solvent neutral oil having a viscosity of 100 cSt at 40° C. The control and blends were stored at 80° C. for 2 weeks and viscosities measured initially and after 1 and 2 weeks. The results are reported in Table 7.

TABLE 7

| Blend | Detergent/Oil | TBN Blend | Viscosity initial | 1 week | 2 weeks |
|---|---|---|---|---|---|
| Control | 100/0 | 400 | 265 | 350 (+32%) | 400 (+51%) |
| 1. | 75/25 | 300 | 73.7 | 79.6 (+8%) | 83.1 (+13%) |
| 2. | 50/50 | 200 | 31.1 | 31.7 (+2%) | 31.7 (+2%) |
| 3. | 25/75 | 100 | 17.5 | 17.7 (+1%) | 17.7 (+1%) |

Results

The bracketed percentages in Table 7 are the percentage viscosity drift measured from the initial viscosity. Table 7 demonstrates that even with modest amounts of a lubricating oil, viscosity drift becomes non-existent. Viscosity drift, as demonstrated in the prior Examples, is present in an overbased detergent. Example 7, in contradistinction, demonstrates that viscosity drift is not present in a finished lubricating oil.

EXAMPLE 8

Overbased Calcium Phenate

An overbased calcium phenate is blended with 2 % by weight canola oil (Blend 1) and with 1% dinonyl phenol (DNP) (Blend 2), and stored at 80° C. for 21 days, and the initial and 21 day viscosities measured and reported in Table 8.

TABLE 8

| Composition | Initial Viscosity | Viscosity after 21 days |
|---|---|---|
| 1. Phenate (neat) | 352 | 419 |
| 2. Phenate with 2% Canola Oil | 305 | 335 |
| 3. Phenate with 1% DNP | 329 | 363 |

Results

The overbased calcium phenate is shown to be subject to viscosity drift. Viscosity drift is minimized in an overbased calcium phenate with additive amounts of a viscosity control agent of the present invention, canola oil and DNP.

EXAMPLE 9

Alkyl Phenol Co-promoter Non-viscosity Drift Control

An overbased calcium sulfonate was prepared using 1.0% by weight of an alkyl phenol promoter and designated Sample No. 1. A second overbased calcium sulfonate was prepared without the use of an alkyl phenol promoter, but with the post formation addition of 0.5% weight of the same alkyl phenol and designated Sample No. 2. A third overbased calcium sulfonate was prepared using the process of Sample No. 2, but Without post formation addition of an alkyl phenol, i.e. no alkyl phenol promoter and no alkyl phenol post formation addition and designated Sample No. 3. Samples Nos. 1, 2 and 3 were stored under the same conditions for 12 days. The initial and 12 day viscosities were measured and are reported for Samples Nos. 1–3 in the following Table 9.

TABLE 9

| Sample No. | Promoter (wt. %) | Post Addition (wt. %) | Viscosity (initial) | Viscosity (12 days) | Viscosity Drift (+ %) |
|---|---|---|---|---|---|
| 1. Alkyl Phenol | 1.0 | | 210 | 276 | 31 |
| 2. Alkyl Phenol | | 0.5 | 181 | 201 | 11 |
| 3. No Additive/ No Promoter | | | 193 | 265 | 35 |

The foregoing Example 9 demonstrates that an alkyl phenol co-promoter, even in an amount of 1.0% by weight, when used to form an overbased calcium sulfonate results in a detergent with viscosity drift. Indeed the detergent viscosity drift of Sample No. 1 was more than 31%. Sample No. 3 demonstrates that in the absence of an alkyl phenol post detergent formation additive, viscosity drift is 35% and comparable to that of Sample No. 1. In marked contrast, Sample No. 2 demonstrates that the post detergent formation addition of only 0.5% by weight of the same alkyl phenol showed significant viscosity drift control, in that there was only an 11 % detergent viscosity drift after 12 days.

Example 7 demonstrates that an agent within the contemplation of the present invention is not necessary or useful to control viscosity drift in a finished oil insofar as viscosity drift is absent in a finished oil. Example 9 demonstrates that when the viscosity drift control agent is used as a co-promoter to form the overbased detergent, the detergent is subject to viscosity drift. The agent defined by the present invention was found to be useful as a viscosity drift control agent when and only when added to the detergent in storage prior to incorporation in the finished oil.

While the invention is demonstrated for certain alkyl phenols, vegetable oils and carboxylic acids, it is to be understood that all such like compounds having an oleophilic group and also having secondary hydroxyl functionality are within the contemplation of the invention.

What is claimed is:

1. A method for controlling viscosity drift in a detergent comprising:

providing an overbased detergent subject to viscosity drift, said overbased detergent selected from the group consisting of Group I and Group II metal sulfonates, phenates and carboxylates;

adding an additive amount of about 0.1 to 5.0% by weight of a viscosity drift control agent consists essentially of at least one selected from an alkyl phenol, a vagetable oil and a carboxylic acid to the detergent, said viscosity drift control agent comprising an oleophilic group and further comprising secondary hydroxyl functionality; and storing said detergent prior to incorporation in a lubricating oil, whereby viscosity drift is reduced.

2. The method of claim 1, wherein the storing is for at least 4 weeks and the viscosity drift of the detergent is less than about 10%.

3. The method of claim 1, wherein the detergent comprises an overbased calcium sulfonate.

4. The method of claim 1, wherein the detergent comprises an overbased calcium phenate.

5. The method of claim 1, wherein the agent comprises an alkyl phenol.

6. The method of claim 5, wherein the alkyl phenol comprises dinonyl phenol.

7. The method of claim 1, wherein the agent comprises a vegetable oil.

8. The method of claim 7, wherein the vegetable oil comprises canola oil.

9. The method of claim 7, wherein the vegetable oil comprises jojoba oil.

10. The method of claim 1, wherein the agent comprises a carboxylic acid.

11. The method of claim 10, wherein the carboxylic acid comprises a hydroxy stearic acid.

12. The method of claim 10, wherein the carboxylic acid comprises a monohydroxy alkane monocarboxylic acid having from 8 to 18 carbon atoms or higher.

13. The method of claim 1, wherein the storing is at about 46° C. to about 49° C. for about 4 weeks, and viscosity drift is no more than about 5 to 25 cSt at 100° C.

14. The method of claim 1, wherein the agent is present in an amount of 0.25 to 1.0% by weight.

15. In combination, an overbased detergent subject to viscosity drift, said overbased detergent selected from the group consisting of Group I and Group II metal sulfonates, phenates and carboxylates; and a viscosity drift control agent for the detergent, said viscosity drift control agent consists essentially of at least one selected from an alkyl phenol, a vegetable oil and a carboxylic acid comprising an oleophilic group and further comprising secondary hydroxyl functionality, said agent being present in an additive amount of about 0.1 to 5.0% by weight, whereby the detergent with the agent over time in storage prior to incorporation in a lubricating oil, the detergent viscosity drift is reduced.

16. The combination of claim 1, wherein the viscosity drift of the detergent is less than about 10% over 4 weeks.

17. The combination of claim 15, wherein the agent is present in an amount of 0.25 to 1.0% by weight.

18. The combination of claim 15, wherein the viscosity drift is no more than about 5 to 25 cSt at 100° C. with the detergent stored at about 46° C. to about 49° C. for about 4 weeks.

19. The combination of claim 15, wherein the detergent comprises an overbased calcium sulfonate.

20. The combination of claim 15, wherein the detergent comprises an overbased calcium phenate.

21. The combination of claim 16, wherein the agent comprises an alkyl phenol.

22. The combination of claim 21, wherein the alkyl phenol comprises dinonyl phenol.

23. The combination of claim 15, wherein the agent comprises a vegetable oil.

24. The combination of claim 23, wherein the vegetable oil comprises canola oil.

25. The combination of claim 23, wherein the vegetable oil comprises jojoba oil.

26. The combination of claim 15, wherein the agent comprises a carboxylic acid.

27. The combination of claim 26, wherein the carboxylic acid comprises a hydroxy stearic acid.

28. The combination of claim 26, wherein the carboxylic acid comprises a monohydroxy alkane monocarboxylic acid having from 8 to 18 carbon atoms or higher.

* * * * *